US006782111B1

(12) United States Patent
Wagner, II et al.

(10) Patent No.: US 6,782,111 B1
(45) Date of Patent: Aug. 24, 2004

(54) MULTIPLE VOICECOIL AND DRIVER TRANSDUCING

(75) Inventors: Peter J. Wagner, II, Shirley, MA (US); Charles R. Barker, III, Framingham, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 09/112,644

(22) Filed: Jul. 9, 1998

(51) Int. Cl.[7] ..... H04R 1/02; H04R 9/06

(52) U.S. Cl. ..... 381/335; 381/401; 381/27

(58) Field of Search ..... 381/27, 61, 401, 381/402, 182, 185, 186, 335, 332, 89, 111, 113, 117

(56) References Cited

U.S. PATENT DOCUMENTS

| | | | | |
|---|---|---|---|---|
| 4,586,192 A | | 4/1986 | Arntson | |
| 4,875,546 A | * | 10/1989 | Krnan | 181/160 |
| 4,980,915 A | * | 12/1990 | Ishikawa | 381/27 |
| 5,117,459 A | | 5/1992 | McShane | |
| 5,175,768 A | | 12/1992 | Daniels | |
| 5,212,732 A | | 5/1993 | Hipps et al. | |
| 5,307,418 A | * | 4/1994 | Sumitani | 381/27 |
| 5,530,760 A | * | 6/1996 | Paisley | 381/27 |
| 5,590,208 A | * | 12/1996 | Koyano et al. | 381/154 |
| 5,594,801 A | | 1/1997 | McShane | |
| 5,850,457 A | * | 12/1998 | Gefvert | 381/18 |
| 6,148,088 A | * | 11/2000 | Suzuki et al. | 381/401 |
| 6,208,742 B1 | * | 3/2001 | Garcia et al. | 381/401 |
| 6,259,799 B1 | * | 7/2001 | Suzuki et al. | 381/401 |
| 6,430,353 B1 | * | 8/2002 | Honda et al. | 386/46 |
| 6,492,909 B1 | * | 12/2002 | Washikawa et al. | 381/77 |

FOREIGN PATENT DOCUMENTS

EP 0 453 230 A2 10/1991

* cited by examiner

*Primary Examiner*—Xu Mei
(74) *Attorney, Agent, or Firm*—Fish & Richardson P.C.

(57) ABSTRACT

A loudspeaker system having a dual voice coil for radiating sound waves from a multiple channel system. The loudspeaker system includes an audio signal input, a first driver having a first voice coil which has a first and a second voice coil winding, and a second driver having a voice coil which has a first and a second voice coil winding. The audio signal input is coupled to the second voice coil winding of the first driver and to the second voice coil of the second driver.

14 Claims, 2 Drawing Sheets

MULTIPLE VOICECOIL AND DRIVER TRANSDUCING

The invention relates to loudspeaker systems, and more particularly to loudspeaker systems for reproducing audio signals from a multiple channel input.

It is an important object of the invention to provide an improved loudspeaker system for reproducing audio signals from a multiple channel input.

According to the invention, a loudspeaker system includes a first audio signal input; a first driver having a dual voice coil, a second driver having a dual voice coil, wherein the first audio signal input is coupled to a voice coil of the first driver and to a voice coil of the second driver.

In another aspect of the invention, a loudspeaker system includes a first driver, a second driver, a left audio channel input, a right audio channel input, and a center audio channel input. The loudspeaker system is constructed and arranged so that sound waves representative of the signal on said center audio channel input and either signal on the left or the right audio channel inputs are radiated by the first driver and so that sound waves representative of the signal on the center audio channel input are radiated by the said first driver and said second driver.

Other features, objects, and advantages will become apparent from the following detailed description, which refers to the following drawings in which.

Figure 1:
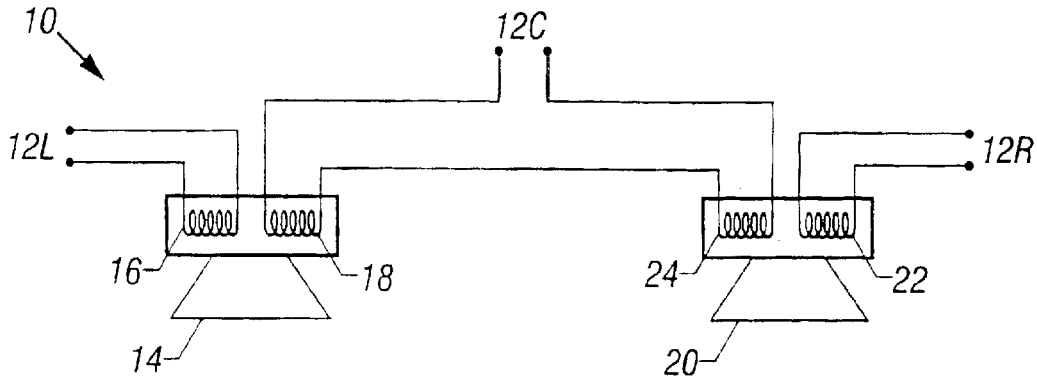
FIG. 1 is a diagrammatic view of a loudspeaker systems according to the invention.

With reference now to the drawings and more particularly to FIG. 1, there is shown a loudspeaker system in accordance with the invention. Loudspeaker system 10 includes three signal input terminals 12L, 12R, and 12C which are coupled to sources of left, right, and center channel signals, respectively. First driver 14 has a dual voice coil having two windings, 16, 18 and second driver 20 has a dual voice coil having two windings 22, 24. Signal input 12L is coupled to first voice coil winding 16 of first driver 14. Signal input 12R is coupled to first voice coil winding 22 of second driver 20. Signal input 12C is coupled to second voice coil winding 18, 24 of first and second drivers, respectively. In operation, first driver 14 radiates sound waves responsive to the left channel signal and the center channel signal; second driver 20 radiates sound waves responsive to the right channel signal and the center channel signal. The result is the left and right channels are radiated by the left and right drivers respectively, while the center channel signal is radiated by both left and right drivers.

Signal inputs 12L, 12C, and 12R may be coupled to signals from a home theater or other signal source having left, right, and center channels. The signals may represent the entire audio frequency range, or may represent a frequency band of the audio frequency range, such as bass frequencies. Drivers 14, 20 may be conventional dual voice coil drivers, with the impedance of second voice coil winding 18, 24 in the range of half the impedance of first voice coil windings 16, 22 so that the impedance as seen by inputs 12L, 12C, is approximately equal.

In one embodiment of the invention, dual coil windings 16, 18, and 22, 24 are implemented as separate windings.

A loudspeaker system according to the invention is advantageous over conventional loudspeaker systems because it enables a two driver system to produce an acoustic effect similar to loudspeaker systems having three drivers. Additionally, when used for a frequency band, such as bass frequencies, a loudspeaker system according to the invention allows greater design flexibility in the selection of other system components, such as the tweeters. A system according to the invention is advantageous over systems which contribute audio channels, because the electronic circuitry is simpler.

Figure 2:
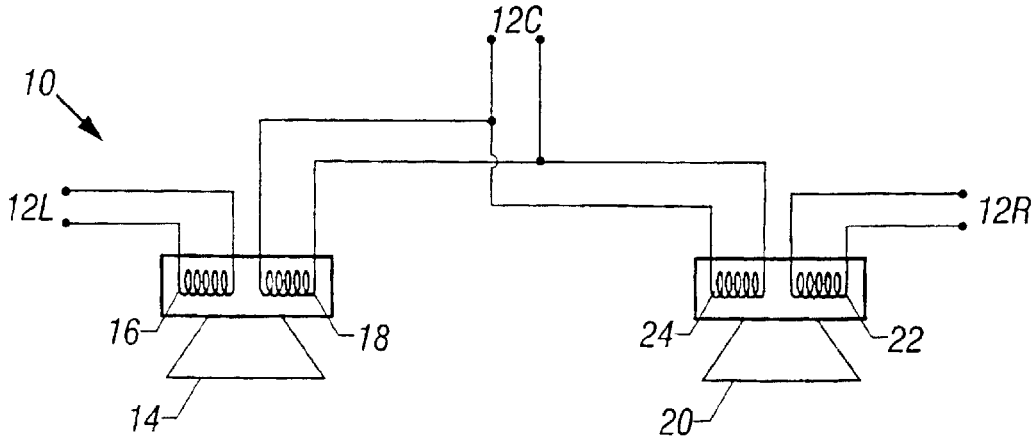
FIG. 2 is a diagrammatic view of an alternate embodiment of the loudspeaker system of FIG. 1.

Referring now to FIG. 2, there is shown a second embodiment of the invention. The elements of FIG. 2 are essentially the same as the elements of FIG. 1, but signal input 12C is coupled to second voice coil windings 18, 24 in parallel. In this embodiment, the impedance of each of second voice coil windings 18, 24 is in the range of twice the impedance of first voice coil winding 16 so that the impedance as seen by inputs 12L, 12C is approximately equal.

Figure 3:
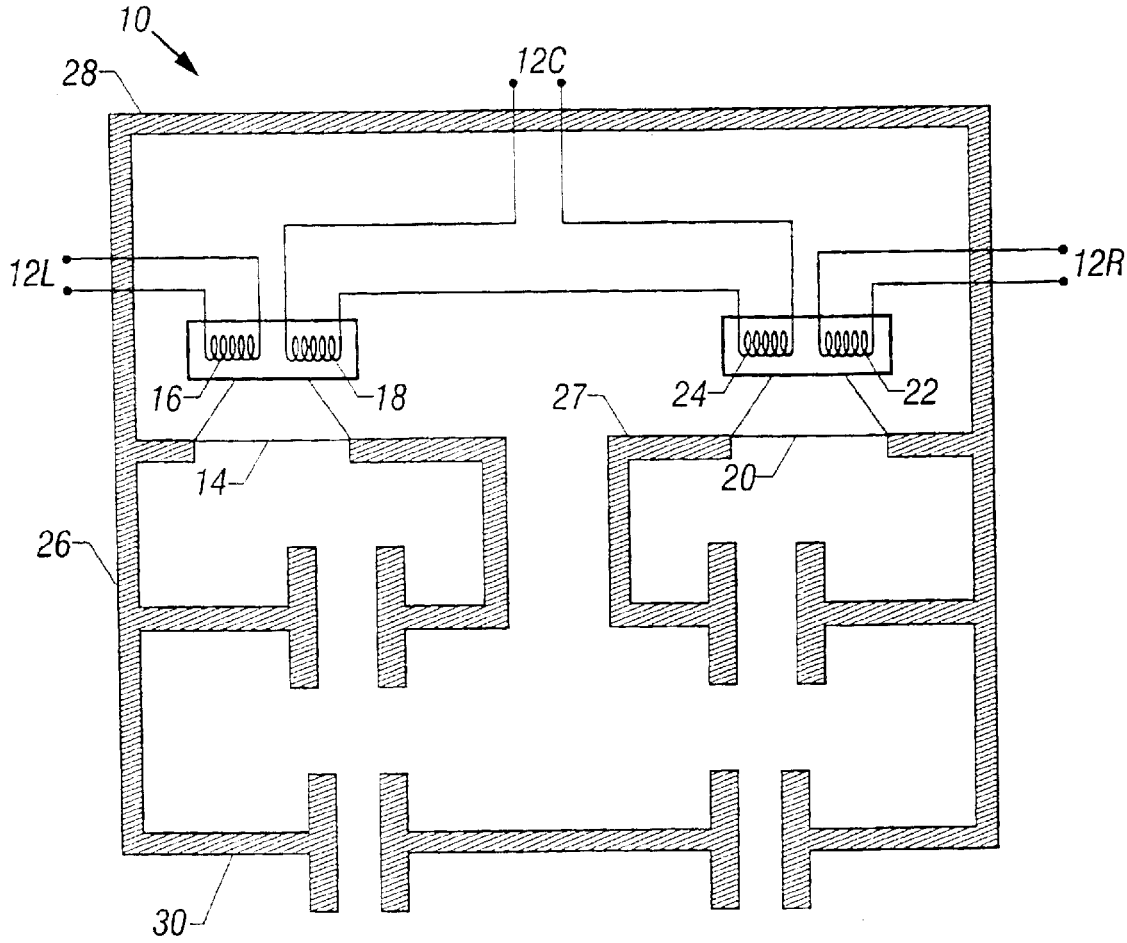
FIG. 3 is a partially diagrammatic, partially cross sectional view of a loudspeaker system according to the invention.

Referring to FIG. 3, there is shown a third embodiment of the invention. The elements of FIG. 3 contains the elements of FIG. 1, with both drivers 14, 20 situated in an enclosure 26. Enclosure 26 may include a baffle 27 in which the drivers 14 and 20 are mounted. Baffle 27 may separate back acoustic element 28 and front acoustic element 30 and may have a port 29 therethrough. In FIG. 3, front acoustic element 30 is shown as a multiple chamber dual ported enclosure, and back acoustic element 28 is shown as a volume, ported to front acoustic element 30. Back acoustic element 28 and front acoustic element 30 can be one of many different types of acoustic elements, such as a closed box, a multiple chamber dual ported enclosure (as is front acoustic element 30 in this view), or one of many other types of acoustic elements, such as waveguides, single chamber ported enclosures, or others. Additionally, either back acoustic element 28 or front acoustic element 30 can be eliminated, so that either back or front surface of drivers 14, 20 radiate directly into the surrounding environment. The embodiment of FIG. 3 is particularly suited to radiating sound waves in the less directional bass frequency range from a single enclosure, while sound waves in the more directional higher frequency ranges are radiated by tweeter drivers (not shown in this view) placed about a listening area. Additionally, the circuitry of FIG. 3 can be replaced by the circuitry of FIG. 2.

Other embodiments are within the claims.

What is claimed is:

1. A loudspeaker system comprising:

first, second and third audio signal inputs for receiving first, second and third different audio signals respectively, a first driver having a first voice coil, said first voice coil having a first and a second voice coil winding;

a second driver having a second voice coil, said second voice coil having a first and a second voice coil winding; wherein said first audio signal input is coupled to said second voice coil winding of said first driver and to said second voice coil of said second driver so that said first driver and said second driver radiate soundwaves representative of said audio signals received by said first audio signal input.

2. A loudspeaker system in accordance with claim 1, wherein said first audio signal input is coupled to said second voice coil winding of said first driver and to said second voice coil of said second driver in series.

3. A loudspeaker system in accordance with claim 1, wherein said first audio signal input is coupled to said second voice coil of said first driver and to said second voice coil of said second driver in parallel.

4. A loudspeaker system in accordance with claim 1 and further comprising an enclosure, wherein said first driver and said second driver are contained in said enclosure.

5. A loudspeaker system in accordance with claim 4, further comprising a baffle, wherein said baffle separates said enclosure into a first acoustic element and a second acoustic element and wherein said first driver and said second driver are mounted in said baffle.

6. A loudspeaker system in accordance with claim 5, wherein said first acoustic element is an enclosed volume.

7. A loudspeaker system in accordance with claim 6, wherein said first acoustic element is a ported volume.

8. A loudspeaker system in accordance with claim 7, wherein said first acoustic element is a multiple chamber ported volume.

9. A loudspeaker system in accordance with claim 1, further comprising a second signal input, wherein said second signal input is coupled to said first voice coil winding of said first driver.

10. A loudspeaker system in accordance with claim 9, further comprising a third signal input, wherein said third signal input is coupled to said first voice coil of said second driver.

11. A loudspeaker system in accordance with claim 9, wherein signals from said first signal input represent a center channel of a multiple channel signal.

12. A loudspeaker system in accordance with claim 9, wherein said first signal input receives signals with spectral components in the bass range.

13. A loudspeaker system comprising, a first driver;

a second driver;

a left audio channel input;

a right audio channel input;

a center audio channel input, wherein said loudspeaker system is constructed and arranged so that sound waves representative of signals on said center audio channel input and on one of said left audio channel input and said right audio channel input are radiated by said first driver and so that sound waves representative of signals on said center audio channel input are radiated by said first driver and said second driver;

wherein said first driver has a voice coil having a first winding and a second winding and wherein said center audio channel input is coupled to said second winding of said first driver.

14. A loudspeaker system in accordance with claim 13, wherein said second driver has a voice coil having a first winding and a second winding and wherein said center audio channel input is coupled to said second winding of said second driver.

* * * * *